US011311772B1

(12) United States Patent
Cooper et al.

(10) Patent No.: US 11,311,772 B1
(45) Date of Patent: Apr. 26, 2022

(54) PHYSICAL EXERCISE APPARATUS

(71) Applicant: PUSH PRODUCT DESIGN, LLC, Birmingham, AL (US)

(72) Inventors: Lloyd Guyton Bowers Cooper, Birmingham, AL (US); Foster D Phillips, Homewood, AL (US)

(73) Assignee: Push Product Design, LLC, Birmingham, AL (US)

( * ) Notice: Subject to any disclaimer, the term of this patent is extended or adjusted under 35 U.S.C. 154(b) by 182 days.

(21) Appl. No.: 15/491,764

(22) Filed: Apr. 19, 2017

Related U.S. Application Data

(60) Provisional application No. 62/324,774, filed on Apr. 19, 2016.

(51) Int. Cl.
*A63B 23/035* (2006.01)
*A63B 22/00* (2006.01)
(Continued)

(52) U.S. Cl.
CPC ..... *A63B 23/03541* (2013.01); *A63B 21/22* (2013.01); *A63B 21/4034* (2015.10);
(Continued)

(58) Field of Classification Search
CPC ..... A63B 23/03541; A63B 21/22; A63B 21/4034; A63B 24/0087; A63B 24/0062; A63B 21/4035; A63B 22/0005; A63B 22/001; A63B 2220/50; A63B 2024/0093; A63B 2220/30; A63B 23/03533; A63B 23/03575; A63B 23/03583; A63B 23/03591; A63B 22/0012; A63B 22/0015; A63B 2022/0041; A63B 2022/0043; A63B 2022/0038; A63B 22/0048; A63B 21/00; A63B 21/00181; A63B 21/00185; A63B 21/005; A63B 21/0053; A63B 21/0058;
(Continued)

(56) References Cited

U.S. PATENT DOCUMENTS 4,846,156 A * 7/1989 Kopnicky ..... A63B 22/0694 601/36
5,330,402 A * 7/1994 Johnson ..... A63B 22/0012 482/52
(Continued)

FOREIGN PATENT DOCUMENTS

DE 102004020006 * 11/2005 ..... A61H 1/0214
DE 102004020006 A1 * 11/2005 ..... A63B 21/00178
DE 102004020006 A1 * 11/2005 ..... A61H 1/0214

OTHER PUBLICATIONS

Krankcycle 101, "Taking your first Spin on the Johnny G KRANKcycle by Matrix" YouTube, Jul. 31, 2012, available at https://www.youtube.com/watch?v=5x7Psl3F_Es.
(Continued)

*Primary Examiner* — Sundhara M Ganesan
*Assistant Examiner* — Shila Jalalzadeh Abyaneh
(74) *Attorney, Agent, or Firm* — Bradley Arant Boult Cummings LLP

(57) ABSTRACT

An exercise apparatus is provided that allows the user to assist the force applied with one arm or leg by exerting force from another appendage, without the use of complex mechanical linkages. The apparatus may also be reconfigured to accommodate the user in a wide variety of positions.

14 Claims, 7 Drawing Sheets

(51) Int. Cl.
*A63B 21/22* (2006.01)
*A63B 24/00* (2006.01)
*A63B 21/00* (2006.01)

(52) U.S. Cl.
CPC ..... *A63B 21/4035* (2015.10); *A63B 22/001* (2013.01); *A63B 22/0005* (2015.10); *A63B 24/0062* (2013.01); *A63B 24/0087* (2013.01); *A63B 2024/0093* (2013.01); *A63B 2220/30* (2013.01); *A63B 2220/50* (2013.01)

(58) Field of Classification Search
CPC ..... A63B 21/0059; A63B 21/157; A63B 21/4027; A63B 21/4033; A63B 21/4045; A63B 21/4047; A63B 21/4049; A63B 22/00; A63B 23/00; A63B 24/00; A63B 21/068; A63B 21/0023; A63B 22/002; A63B 23/12; A63B 22/0007; A63B 22/0076; A63B 22/0025; A63B 2022/0033; A63B 2022/0035; A63B 2022/0092; A63B 2022/0094; A63B 22/0292; A63B 22/06; A63B 22/0605; A63B 2022/0611; A63B 2022/0617; A63B 2022/0635; A63B 23/035; A63B 23/03516; A63B 23/03525; A63B 23/0355; A63B 23/04; A63B 69/00; A63B 23/0476; A63B 2024/0009; A63B 2024/0012; A63B 2024/0015; A63B 24/0059; A63B 2024/0065; A63B 2071/0072; A63B 71/0622; A63B 2071/0652; A63B 2220/51; A63B 2220/54
See application file for complete search history.

(56) References Cited

U.S. PATENT DOCUMENTS 5,496,238 A * 3/1996 Taylor ..... A63B 21/0083 482/57
6,036,623 A * 3/2000 Mitchell ..... A63B 23/03575 482/57
6,942,603 B1 * 9/2005 Tsai ..... A63B 21/00181 482/5
6,960,155 B2 * 11/2005 Chien ..... A63B 22/0005 482/62
8,602,943 B2 * 12/2013 Andreasen ..... A63B 21/002 482/7
2005/0143226 A1 * 6/2005 Heidecke ..... A63B 22/0023 482/62
2006/0094569 A1 * 5/2006 Day ..... A63B 24/00 482/57
2012/0316035 A1 * 12/2012 Andreasen ..... A63B 23/0417 482/7
2012/0322625 A1 * 12/2012 Park ..... A63B 22/0605 482/62
2015/0141200 A1 * 5/2015 Murray ..... A63B 21/154 482/5
2017/0291061 A1 * 10/2017 Lee ..... A63B 22/0012

OTHER PUBLICATIONS

NuStep LLC, "T5 Orientation v3 2015" YouTube, Jan. 26, 2016, available at https://www.youtube.com/watch?v=j94aWnHyil.
Scifit, "PRO2 Total Body Exerciser from SCIFIT" YouTube, Jul. 15, 2011, available at https://www.youtube.com/watch?v=qu9AGv-zg6M.
MOTOmedTherapy, "MOTOmed models, features and therapy options (part 1 of 2)" YouTube, Jul. 22, 2010, available at https://www.youtube.com/watch?v=7-QohoqYng4.
MOTOmedTherapy, "MOTOmed models, features and therapy options (part 2 of 2)" YouTube, Jul. 22, 2010, available at https://www.youtube.com/watch?v=dTT4BgHba8o.
Pohl, M., et al. Repetitive locomotor training and physiotherapy improve walking and basic activities of daily living after stroke: a single-blind, randomized multicentre trial (DEutsche GAngtrainerStudie, DEGAS) Clinical Rehabilitation, 2007; 21: 17-27; pp. 1-11.
Conesa, et al. "An obervational report of intense robotic and manual gait training in sub-acute stroke" Journal of NeuroEngineering and Rehabilitation, 2012, 9:13; Feb. 13, 2012; pp. 1-10.
Schmidt, Henning, et al. "Gait rehabilitation machines based on programmable footplates" Journal of NeuroEngineering and Rehabilitation, 4:2; Feb. 9, 2007; pp. 1-7.
Yang, Jaynie F., et al. "Training to achieve over ground walking after spinal cord injury: A review of who, what, when, and how" The Journal of Spinal Cord Medicine, 2012, vol. 35, No. 5; pp. 293-304.
Munari, Daniel, et al. "High-intensity treadmill training improves gait ability, VO2peak and cost of walking in stroke survivors: preliminary results of a pilot randomized controlled trial" European Journal of Physical and Rehabilitation Medicine; Jun. 2018, 54(3); pp. 408-418.

* cited by examiner

PHYSICAL EXERCISE APPARATUS

CROSS-REFERENCE TO RELATED APPLICATIONS

This application cites the benefit of the filing date of provisional U.S. Patent Application No. 62/324,774 (filed 19 Apr. 2016) under 35 U.S.C. § 119. The contents of U.S. Patent Application No. 62/324,774 are incorporated herein by reference in their entirety.

STATEMENT REGARDING FEDERAL FUNDING

This invention was made with government support under the U.S. Department of Health and Human Services, National Institute on Disability, Independent Living, and Rehabilitation Research grant number 90RE5009-01-00. The government has certain rights in the invention.

In this context "government" refers to the government of the United States of America.

BACKGROUND

A. Field of the Disclosure

The present disclosure relates generally to apparatuses for exercise, training, and physical rehabilitation. The present disclosure relates specifically to such apparatuses for use by disabled persons, as well as able-bodied persons.

B. Background

Stationary exercise apparatuses are in widespread use. They can provide uniform, low-impact, variable levels of resistance while requiring very little space. As a result, they can be used indoors regardless of the weather. Their ability to impart adjustable levels of resistance makes them useful for multiple users of varying levels of strength and endurance, and can also be used by the same individual with differing daily workout goals (for example, a user might alternate short high-intensity workouts with longer endurance workouts).

However, existing exercise apparatuses have limitations. Although they sometimes adjust to allow users of different sizes to use them, they cannot be adjusted to be used in many different positions. As a result, a gym or rehabilitation facility must decide to allocate funds between treadmills to simulate running, stationary bikes to simulate bicycling, elliptical trainers to simulate cross-country skiing, etc. There is no exercise apparatus flexible enough to fulfill all of these needs.

Furthermore, existing exercise apparatuses provide uniform and symmetrical resistance to the user's arms and legs. This is considered a basic requirement of the apparatus, as injury can result from the asymmetrical development of the body in some cases. However, it is common for an injury or disability to affect one saggital side of the body more than the other; it is also common for an injury or disability to affect upper and lower appendages differently. Currently, there is no exercise apparatus that is capable of providing such asymmetrical resistance or assistance for such persons.

DETAILED DESCRIPTION

A. Definitions

Figure 1:
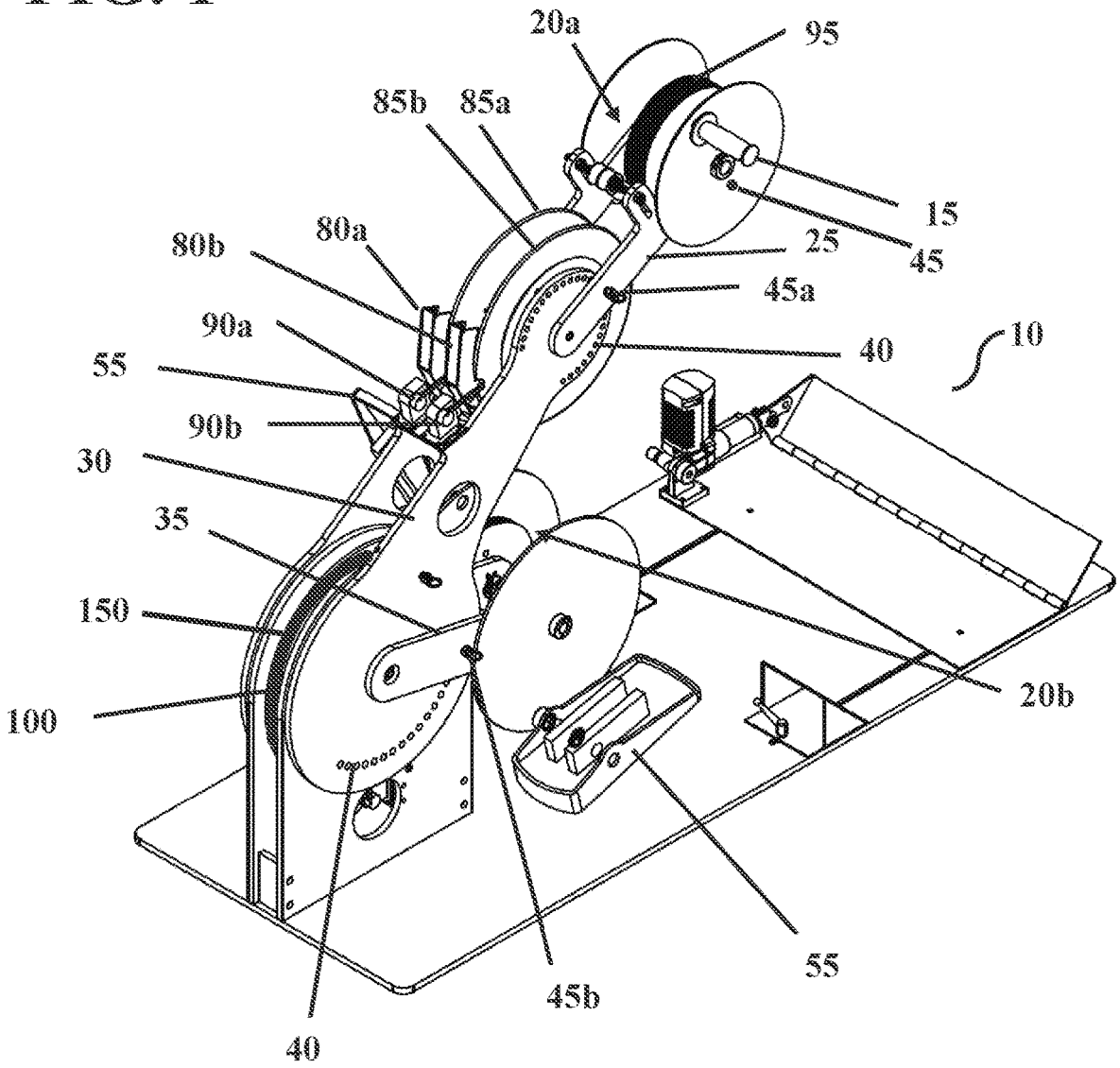
FIG. 1. An embodiment of the apparatus in a first configuration.
Figure 2:
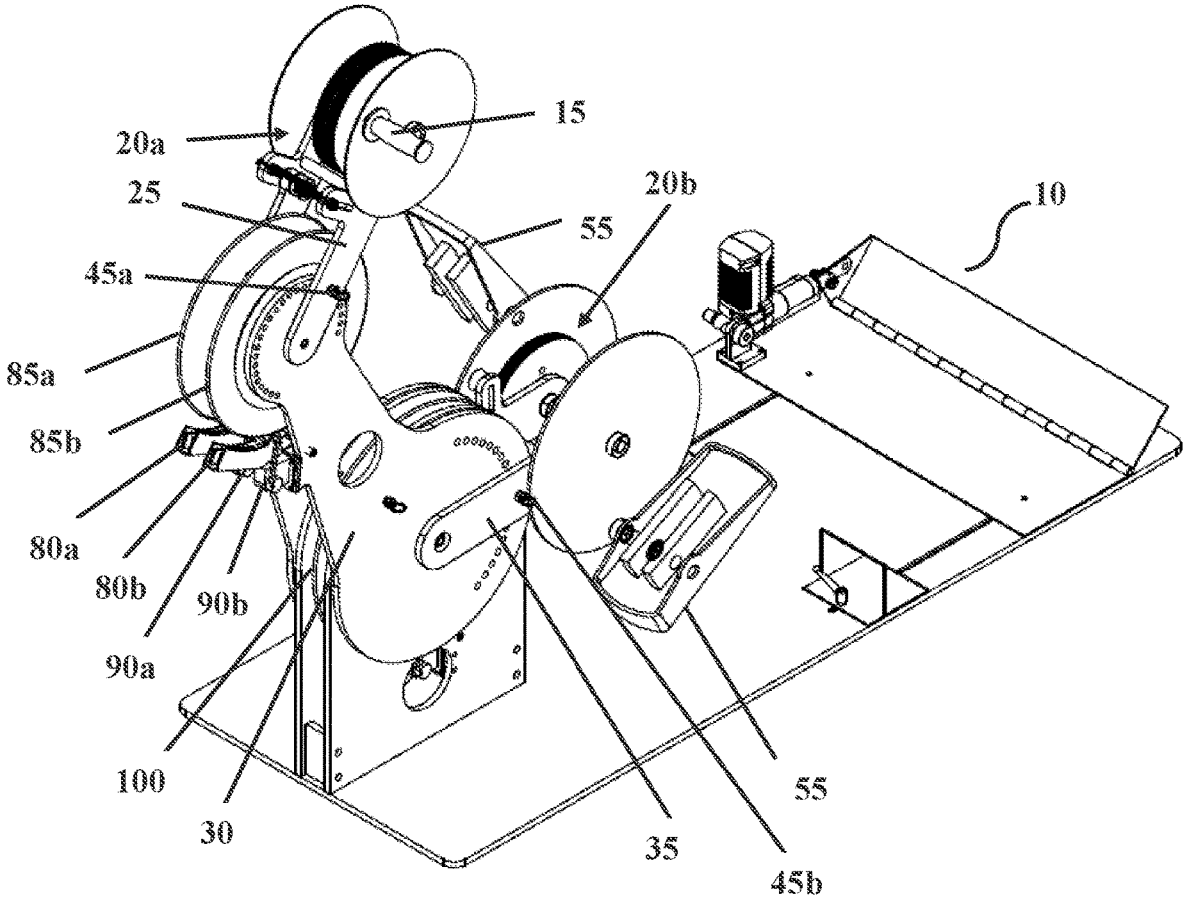
FIG. 2. An embodiment of the apparatus in a second configuration.
Figure 3:
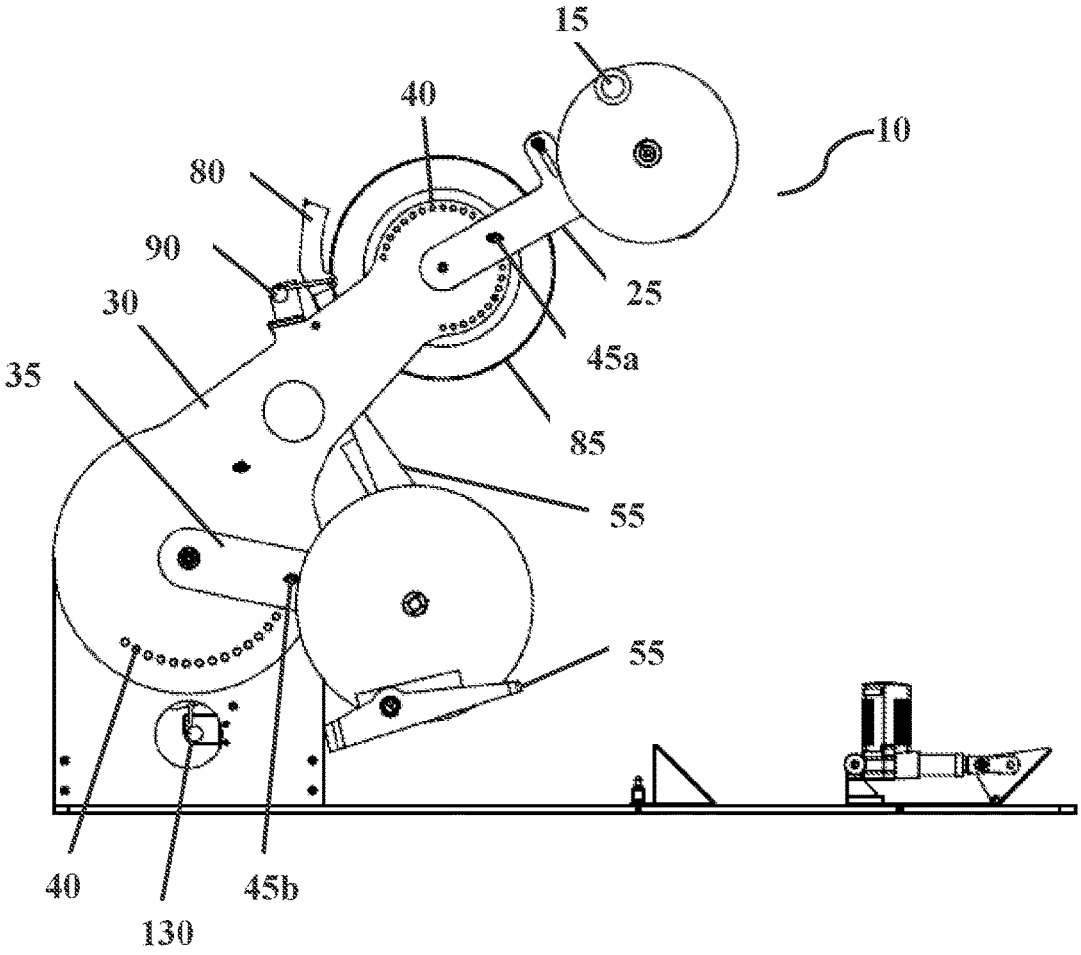
FIG. 3. A plan side view of the embodiment of the apparatus shown in FIG. 1 in the first configuration.
Figure 4:
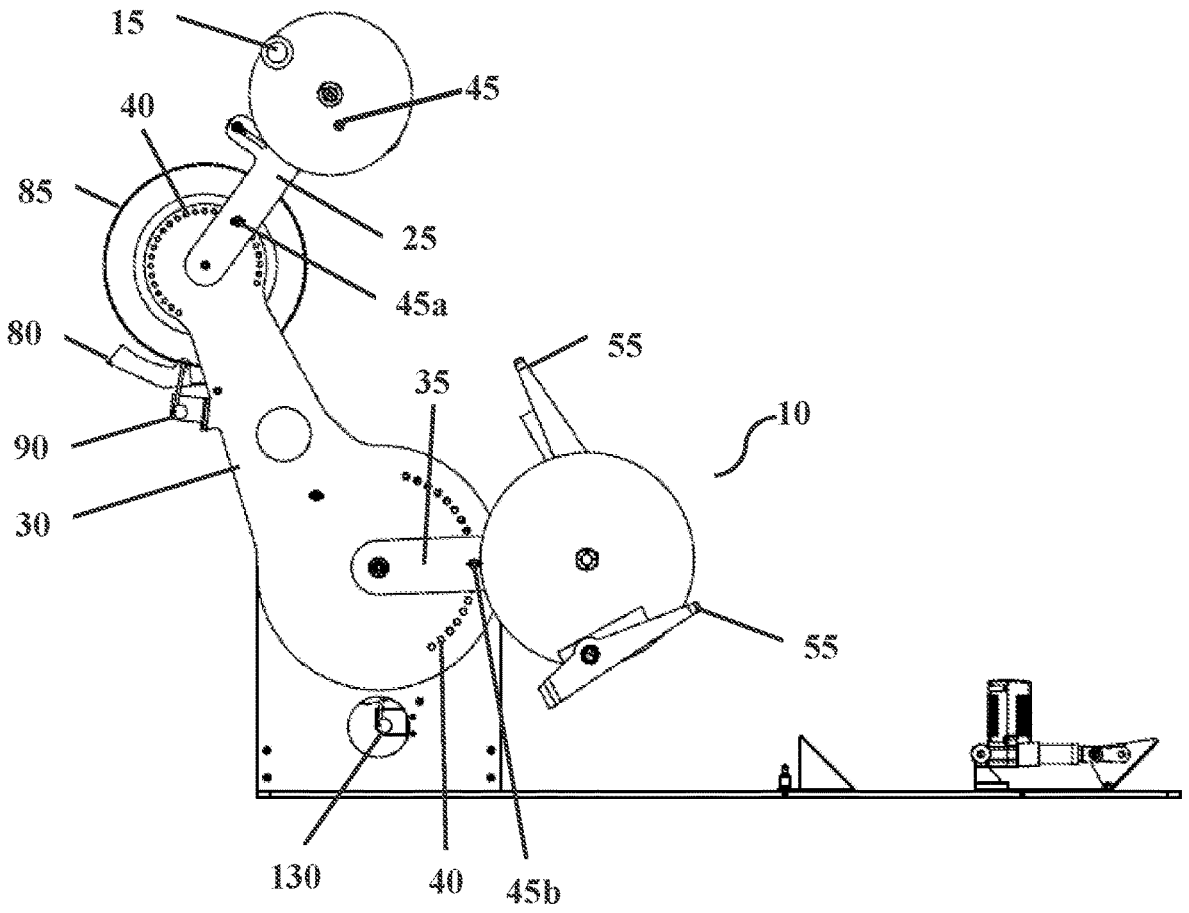
FIG. 4. A plan side view of the embodiment of the apparatus shown in FIG. 2 in the second configuration.
Figure 5:
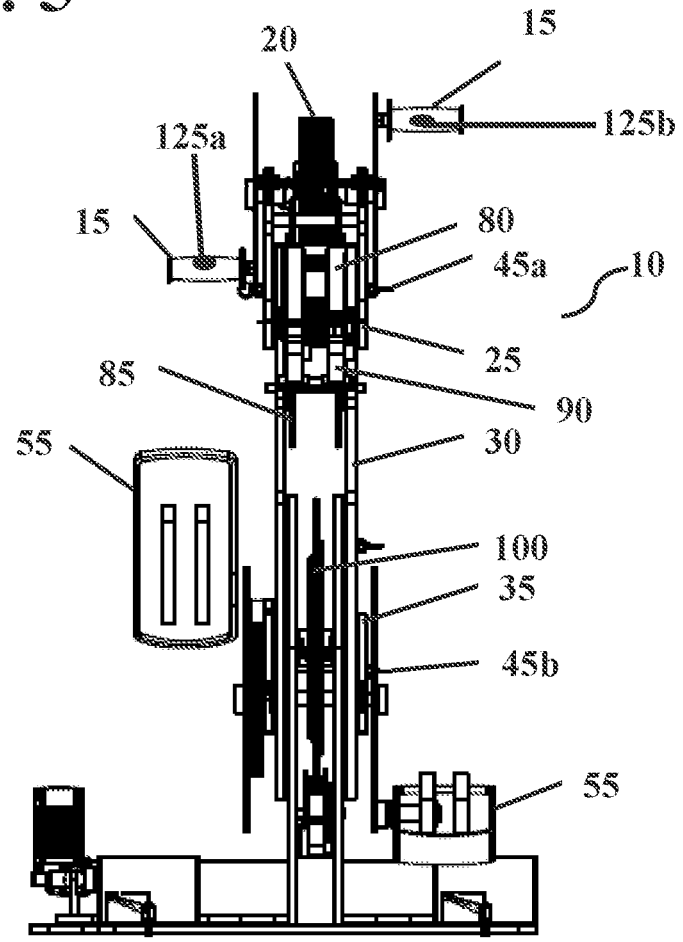
FIG. 5. A front view of an embodiment of the apparatus.
Figure 6:
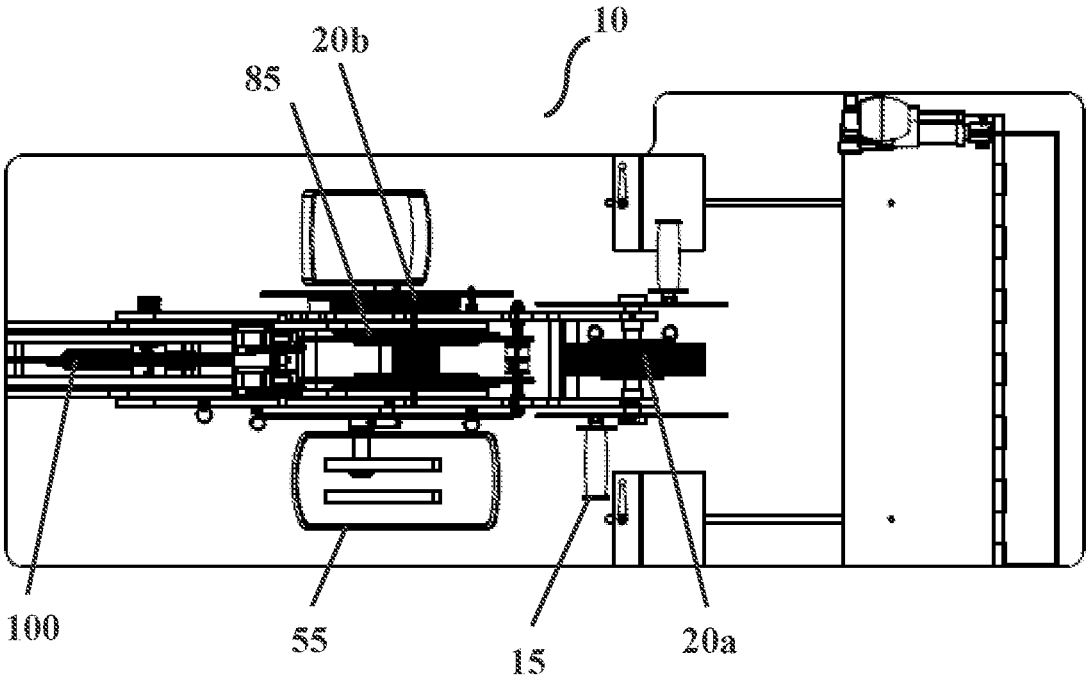
FIG. 6. A top view of an embodiment of the apparatus.
Figure 7:
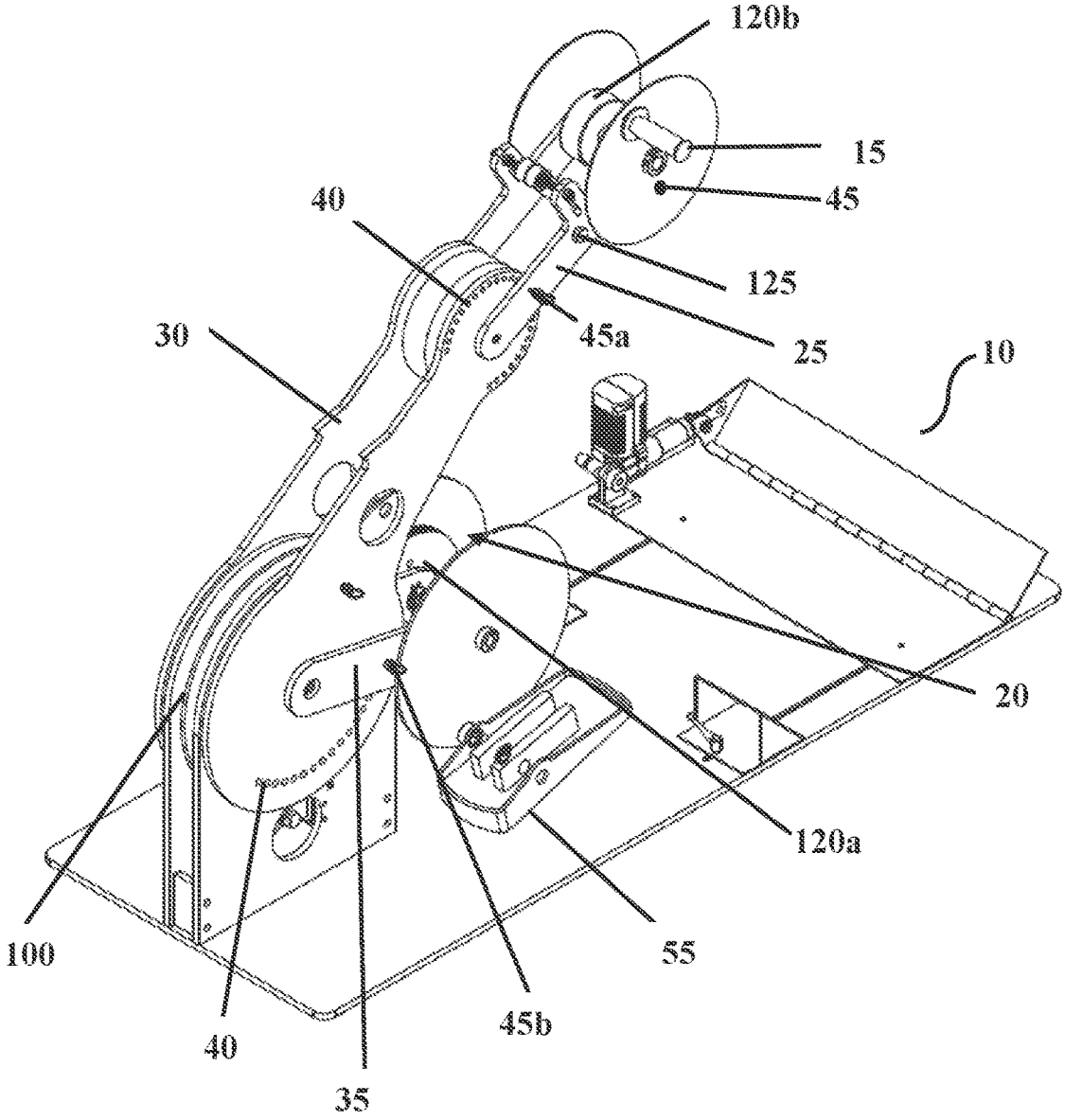
FIG. 7. An alternative embodiment of the apparatus.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting. As used herein, the singular forms "a", "an" and "the" are intended to include the plural forms as well, unless the context clearly indicates otherwise.

Spatially relative terms, such as "under", "below", "lower", "over", "upper" and the like, may be used herein for ease of description to describe one element or feature's relationship to another when the apparatus is right side up.

The terms "first", "second", and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The term "consisting essentially of" means that, in addition to the recited elements, what is claimed may also contain other elements (steps, structures, ingredients, components, etc.) that do not adversely affect the operability of what is claimed for its intended purpose as stated in this disclosure. Importantly, this term excludes such other elements that adversely affect the operability of what is claimed for its intended purpose as stated in this disclosure, even if such other elements might enhance the operability of what is claimed for some other purpose.

The terms "user", "individual", "subject" or "patient" as used herein refers to any animal, including mammals, such as mice, rats, other rodents, rabbits, dogs, cats, swine, cattle, sheep, horses, or primates, and humans. The term may specify male or female or both, or exclude male or female.

B. First Aspect

A first aspect of the apparatus 10 allows differential resistance to be applied to a user's right and left sides, although of course equal resistance may be used as well. In the first aspect, an exercise apparatus 10 is provided that is suitable for a user with sagittally unequal body strength or sagittally balanced body strength, the apparatus 10 comprising: (a) means for receiving force imparted by the user's right arm; (b) means for receiving force imparted by the user's left arm; (c) means for providing resistance against the force imparted by the user's right arm; (d) means for providing resistance against the force imparted by the user's left arm; (e) means for varying the resistance provided by (c) independent of the resistance provided by (d); (f) means for varying the resistance provided by (d) independent of the resistance provided by (c); and (g) means for coupling and uncoupling (a) and (b) to receive an aggregate force imparted by the user's right arm and the user's left arm.

The first aspect can also include means for receiving force from the user's left leg and means for receiving force from the user's right leg. Like the arm units, the leg units may have associated means for providing resistance, and in some embodiments there are means for varying the resistance provided by each means for providing the resistance. In further embodiments, there are means for coupling and uncoupling the means for receiving force from the user's legs.

The means for receiving force imparted by the user's right arm or left arm are not limited, and may include without limitation a handle 15, a crank, a lever, a row bar, an oscillating handle, and a reciprocating handle. Some embodiments of the means for receiving force imparted by the user's right arm or left arm are configured to provide rotational motion to a drive linkage, such as a belt drive 20. The drive linkage may be coupled to a means for providing resistance via a belt 95 or similar device (e.g., a chain, rope, etc.). The means for receiving force imparted by the user's right arm or left arm may also receive force by other parts of the upper extremities, such as the hands, fingers, chest, and back.

The means for receiving force imparted by the user's right leg or left leg are not limited, and may include without limitation a pedal 55, a pedal on a crank, a footpad, an ankle band, etc. It may be attached to a circular crank, an elliptical crank, reciprocating arms, pivoting arms, sliding arms, or other means to allow the means for receiving force to move along a defined path. Some embodiments of the means for receiving force imparted by the user's right leg or left leg are configured to provide rotational motion to a drive linkage. The drive linkage may be coupled to a means for providing resistance via a belt 95 or similar device (e.g., a chain, rope, etc.). The means for receiving force imparted by the user's right leg or left leg may also receive force by other parts of the lower extremities, such as the feet, toes, buttocks, and lower back.

The means for providing resistance may be any known in the art. These generally work by imparting friction to the system, like a friction brake. However, they may also work by imparting magnetic resistance, for example by using a magnetic brake 80 to impart resistant force to a flywheel 85. In some embodiments of the apparatus 10 the means for providing resistance is a drive motor 120 that is positioned to exert force that resists the force imparted by the arms and legs.

The means for varying the resistance may be any that a person of ordinary skill in the art would understand to be suitable. For example, the means for varying the resistance of a magnetic brake 80 could be an actuator 90 that varies the distance from the brake 80 to the flywheel 85. As another example, the means for varying the resistance of a friction brake could be an actuator 90 that presses the brake pad against the flywheel 85. As another example, the means for varying the resistance of a drive motor 120 could be a controller that modulates the force exerted by the drive motor 120

The means for coupling and uncoupling the means for receiving force from the hands serves to allow an aggregate force to be exerted by both hands, enabling uniform resistance to be applied to the user's hands. If uncoupled, it allows differential resistance to be applied to the user's hands. An example of a means for coupling and uncoupling is a locking pin 45 that locks two drive linkages in synchrony, when the drive linkages (such as belt drives 20) are directly driven by the means for receiving force from the hands.

C. Second Aspect

A second aspect of the apparatus 10 allows the relative positions of the arms units and the foot units to be varied in a wide array of positions, such as standing, sitting bicycle-style, sitting recumbent, seated in a wheelchair, etc. In the second aspect, an exercise apparatus 10 is provided that is suitable for a user in a variety of body positions, the apparatus 10 comprising: (a) means for receiving force imparted by at least one of the user's arms; (b) means for providing resistance to the force imparted by said at least one of the user's arms; (c) means for relocating (a) along a first arc having a first center; (d) means for relocating the first center along a second arc having a second center; (e) means for receiving force imparted by at least one of the user's legs; (f) means for providing resistance to the force imparted by said at least one of the user's legs; and (g) means for relocating (e) along a third arc having a third center.

The means for receiving force imparted from the user's arms and/or legs in the second aspect may be any that would be suitable in the first aspect. Likewise, the means for providing resistance in the second aspect may be any that would be suitable in the first aspect.

The means for relocating (a) along the first arc may be any known in the art, including a first boom 25 that is pivoted to allow it to rotate around the center of the first arc. In this context the first "boom" 25 is any elongate structure capable of at least partially supporting (a) while moving through the arc. The means for relocating the first center along a second arc having a second center may be any known in the art, including a second boom 30 that is pivoted to allow it to rotate around the center of the arc. In this context the second boom 30 is any elongate structure capable of at least partially supporting (a) while moving through the arc.

The means for relocating (e) along a third arc having a third center may be any known in the art, including a boom 35 that is pivoted to allow it to rotate around the center of the arc. In this context the third boom 35 is any elongate structure capable of at least partially supporting (e) while moving through the arc. In a specific embodiment, the center of the third arc is at least approximately the same as the center of the second arc. As is shown in FIG. 1, both means for receiving force from the user's legs and the central boom ("second boom") 30 rotate around the same axis, allowing the apparatus 10 to assume a very wide array of positions without disassembly.

Any arc referred to in this disclosure may be, for example, the arc of a circle, in which case the center will be the center of the circle. Any such arc may also be an arc of an ellipse, in which case the center could be considered the center of the ellipse. Arcs of more complex curves are of course possible.

D. Third Aspect

A third aspect allows the user to provide perceived assistive force to one appendage (arm or leg) by increasing the force the user exerts with another appendage. In the third aspect, an exercise apparatus 10 is provided that is capable of creating coupled resistance to any combination of a user's arms and legs, the apparatus 10 comprising: (a) means for receiving force imparted by the user's right arm; (b) means for receiving force imparted by the user's left arm; (c) means for reversibly aggregating the force imparted by the user's right arm and the force imparted by the user's left arm into an aggregate arm force; (d) means for providing resistance against the aggregate arm force; (e) means for providing independent resistances against the force imparted by the user's right arm and the force imparted by the user's right arm; (f) means for engaging and disengaging (d) or (e); (g) means for receiving force imparted by the user's right leg; (h) means for receiving force imparted by the user's left leg; (i) means for reversibly aggregating the force imparted by the user's right leg and the force imparted by the user's left leg into an aggregate leg force; (j) means for providing resistance against the aggregate leg force; (k) means for providing independent resistances against the force imparted by the user's right leg and the force imparted by the user's right leg; (l) means for engaging and disengaging (j) or (k); (m) means for imparting assisting force to (a) that is proportional to the force imparted by one of: the user's right leg and the user's left leg; and (n) means for imparting assisting force to (b) that is proportional to the force imparted by one of: the user's right leg and the user's left leg.

The means for receiving force imparted by the user's legs and arms may be any that are disclosed as suitable in the other aspects of the apparatus 10.

The means for aggregating the forces from the user's appendages may include, for example, a locking pin 45 that acts to couple a force input means to a shaft means that can be used to either connect both of the arm units or both of the foot units to the means that imparts resistance, such as a magnetic brake 80. When the locking pin is withdrawn, the force from each arm or each leg is subject to independent resistance. When the locking pin 45 in inserted, the force from each arm or each leg is aggregated, and the aggregate force is subject to resistance.

The means for providing independent resistance may be any disclosed as suitable in any of the other aspects of the apparatus 10. Examples include a flywheel 85, a pair of flywheels, or either of the foregoing with a brake (such as a magnetic brake 80) or drive motor 120. The means for providing resistance against the aggregated force(s) may be the same in nature as any means for providing resistance disclosed above, although it will be configured to resist aggregated force from two appendages, as opposed to only from one appendage.

The means for engaging and disengaging the means for providing independent and aggregated resistance may be for example a pair of flywheels 85 capable of being locked in synchrony or alternatively capable of rotating independently.

The means for providing assisting force may be any that would be understood to be suitable by a person of ordinary skill in the art. In some embodiments of the apparatus 10, the means for providing assisting force can be modulated, to increase or to decrease the assisting force. One such example is a drive motor 120, such as a drive motor 120 coupled to a drive motor controller.

E. Fourth Aspect

In a fourth aspect, an exercise apparatus 10 is provided that is capable of accommodating a user in a wide variety of positions and providing resistance to force imparted by a user's arms and legs, the apparatus 10 comprising: (a) a pair of movable handles 15 intended to be held in the user's hands; (b) a pair of belt drives coupled to translate the motion of the movable handles 15 into rotation of the belt drives; (c) a pair of belts positioned to be driven by the belt drives; (d) a first flywheel 85*a* to receive rotational force from the pair of belts; (e) a first magnetic brake 80*a* positioned to exert braking force on the flywheel 85*a* to increase resistance to movement of the handles 15; (f) a first actuator 90*a* coupled to the first brake 80*a* and positioned to vary the distance between the first brake 80*a* and the first flywheel 85*a*; (g) an firstboom 25 supporting the pair of movable handles 15, and configured to rotate the pair of movable handles 15 along a first arc having a first center; (h) a second boom 30 supporting the first boom 25, and configured to rotate the first center along a second arc having a second center; (i) a pair of movable foot pedals 55 intended to contact the user's feet; (j) a third boom 35 supporting the pair of foot pedals 55 and configured to rotate the pair of foot pedals 55 along a third arc having the second center; (k) a second belt drive coupled to translate motion of the foot pedals 55 into rotation of the second belt drive; (l) a second belt 150 positioned to be driven by the second belt drive; and (m) a second flywheel 100 to receive rotational force from the second belt 150.

It is contemplated that the belt drives (20*a*, 20*b*) could be replaced by other forms of drive linkages, such as one or more drive motors 120.

In the fourth aspect, each handle 15 translates the force from the user to one of a pair of belt drives. The pedals 55 may translate the total force they receive to one belt drive 20, or the apparatus 10 may comprise a second pair of belt drives, in which case each pedal 55 translates the force from the user to one of the belt drives. Such embodiments would of course comprise a second pair of belts, and a corresponding second pair of flywheels. The magnetic resistance to a given flywheel will increase as the distance of the brake to the flywheel decreases.

In some embodiments of the apparatus 10, the booms rotate through their respective arcs, and are held in position using a locking pin 45 or similar structure. For example, in the embodiment shown in FIG. 1, the upper ("first") boom 25 comprises a first locking pin 45*a*, and the second boom 30 comprises a plurality of pinholes 40 along an arc of about 270° that are positioned to accept the first locking pin 45*a*. The third boom 35 also comprises a locking pin ("second locking pin") 45*b*, and the first boom 25 has another plurality of pinholes 40 along an arc of about 90° that are positioned to accept the second locking pin 45*b*. This exemplary configuration allows the handles 15 and the foot pedals 55 to be independently relocated to a wide variety of positions. For example, the handles 15 may be located nearly anywhere within a radius of the third center equal to the sum of the distance from the handles 15 to the first center and the distance from the first center to the first center. The foot pedals 55 may be located nearly anywhere in a 180° arc the radius of the third boom 35.

Some embodiments of the apparatus 10 comprise a first sensor 125*a* positioned to measure the motion of the pair of moveable handles 15. The measured motion may be speed, force, cadence, or energy. In such embodiments a first drive motor 120*a* is connected to the pair of movable foot pedals 55 to impart assistive force to the pair of moveable foot pedals 55; a first drive motor controller connected to receive the speed of the pair of movable handles 15 from the first sensor 125*a* and regulate the assistive force imparted by the first drive motor 120*a* proportionally to the motion of the pair of movable handles 15. Using these structures, the user can provide assistive force to a relatively weak appendage by increasing the force she exerts using a relatively strong appendage. This can aid in rehabilitation and training, and also teach coordination. Some embodiments comprise a first pair of sensors (125*a*, 125*b*), each one positioned to measure the motion of one of the movable handles 15. In such embodiments each of the handles 15 may receive different assistive force from the other, to account for differences in strength between the user's left and right arms.

In an alternate embodiment of the apparatus 10, the brakes, actuators and flywheels may be replaced by one or more drive motors 120 positioned to provide resistance to one or more of the movable handles 15 or movable foot pedals 55. A drive motor controller may also be present to modulate the degree of resistance provided. The controller may be actively controlled by the user, or may respond to input from automated sensors 125. In a specific embodiment of the apparatus 10, the resistance drive motor is the same as the first drive motor 120*a*, such that the first drive motor 120*a* can provide both resistant and assisting force, depending on the user's needs.

In some embodiments of the apparatus 10, there is a second sensor 125*b* positioned to measure the motion of the pair of foot pedals 55; a second drive motor 120*b* connected to the pair of movable handles 15 to impart assistive force to the pair of moveable handles 15; and a second drive motor controller connected to receive the motion measurement of the pair of foot pedals 55 from the second sensor 125*b* and regulate the assistive force imparted by the second drive motor 120*b* proportionally to the motion of the pair of foot pedals 55. Some embodiments comprise a second pair of sensors, each one positioned to measure the motion of one of the foot pedals 55. In such embodiments each of the foot pedals 55 may receive different assistive force from the other, to account for differences in strength between the user's left and right legs. In a specific embodiment of the apparatus 10, the second drive motor 122*b* can provide both resistant and assisting force, depending on the user's needs.

Additional features may be found on the apparatus 10. It may include a seat for the user. The second and third boom 35 may be attached to a load bearing stand. A wheel chock may be present to allow a user in a wheelchair to use the apparatus 10. Some embodiments of the wheel chock comprise a wheel chock actuator to raise and lower the chock, in communication with a wheel chock controller. The wheel chock controller may be coupled to a motion sensor or proximity sensor, which raises and lowers the chock based on the position or motion of the wheelchair.

F. Fifth Aspect

In a fifth aspect the user may exert force from any appendage to receive assistive force for any other appendage. In the fifth aspect, an exercise apparatus 10 is provided that is capable of providing modulated resistance or assistance to the user, the apparatus 10 comprising: (a) means for receiving a first force imparted by a first appendage of the user; (b) means for receiving a second force imparted by a second appendage of the user; and (c) means for imparting a first resistance or assistance to the first force that is proportional to the second force. Such means for imparting resistance or assistance may be any described as suitable in the above aspects, including a friction brake, magnetic brake 80, a drive motor 120, or a combination of any of the foregoing. The first and second appendages are selected from the user's right arm, left arm, right leg, and left leg, limited only in that the first and second appendages cannot be the same appendage. The apparatus 10 may further comprise means for receiving a third force imparted by a third appendage of the user; furthermore the apparatus 10 may further comprise means for receiving a fourth force imparted by a fourth appendage of the user. The means for receiving the first through fourth forces can be any disclosed above as suitable for receiving force from the arms or legs. The assistive force is provided electronically, using a sensor (such as a tachometer) to measure the motion (such as speed, force, cadence, or energy) of each of the means to receive force from the appendages, in communication with a plurality of drive motors 120 and/or magnetic brakes 80, each positioned to provide resistance or assistance (or both) to the appendage in question. The resistance will generally vary according to an inverse function of the force received by the other appendage, although for some forms of training this might not be so. The assistance will generally vary according to a direct function of the force received by the other appendage. In a specific embodiment of the apparatus 10 both resistance and assistance is provided by one or more drive motors 120. The sensor 125 may communicate with the brakes and/or motors by wire or wirelessly.

G. Conclusions

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and are capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational queues. These headings shall not limit or characterize the invention(s) set forth herein.

We claim:

1. An exercise apparatus suitable for a user in a variety of body positions, the apparatus comprising:

(a) means for receiving force imparted by the user's right arm;

(b) means for receiving force imparted by the user's left arm;

(c) means for providing both resistance and assistance to (a);

(d) means for providing both resistance and assistance to (b) independent of (a);

(e) means for relocating (a) and (b) together along a first arc having a first center;

(f) means for relocating the first center along a second arc having a second center;

(g) means for receiving force imparted by the user's legs;

(h) means for providing both resistance and assistance to the force imparted by the user's legs; and (i) means for relocating (g) along a third arc having a third center;

wherein at least one of (c) and (d) is configured to provide resistance and assistance to one of the user's arms as a function of a force imparted by the other of the user's arms.

2. The apparatus of claim 1, wherein the third center is approximately the same as the second center.

3. The apparatus of claim 1, wherein at least one of (e), (f), and (i) is a boom.

4. The apparatus of claim 1, wherein (e) is a first boom, (f) is a second boom, and (i) is a third boom.

5. The apparatus of claim 1, wherein (g) is selected from the group comprising: a pedal, a pedal on a crank, a footpad, and an ankle band.

6. The apparatus of claim 1, wherein at least one of (c), (d) and (h) is a drive motor.

7. The apparatus of claim 1, wherein (c), (d) and (h) are each individual drive motors.

8. The apparatus of claim 1, wherein one of (c) and (d) is configured to provide assistance that is the function of a force imparted by one or more of: the opposite arm, a right leg, and a left leg.

9. The apparatus of claim 1, wherein (h) is configured to provide assistance to said at least one of the user's legs that is the function of a force imparted by one or more of: the opposite leg, a right arm, and a left arm.

10. An exercise apparatus suitable for a user in a variety of body positions, the apparatus comprising:

(a) a first left and first right rotating crank for receiving force imparted by the user's arms, wherein the first left crank and the first right rotating crank rotate around a first common axis;

(b) means for providing both resistance and assistance to the force imparted by the user's arms, wherein said resistance and assistance may be differential between right and left sides;

(c) means for relocating the first common axis along a first arc having a first center;

(d) means for relocating the first center along a second arc having a second center;

(e) a second left and second right rotating crank for receiving force imparted by the user's legs, wherein the second left crank and the second right crank rotate around a second common axis;

(f) means for providing both resistance and assistance to the force imparted by the user's legs, wherein said resistance and assistance may be differential between right and left sides; and (g) means for relocating the second common axis along a third arc having a third center.

11. The apparatus of claim 10, wherein:

(b) is capable of providing differential resistance and assistance to the right side independent of the left side; and (f) is capable of providing differential resistance and assistance to the right side independent of the left side.

12. An exercise apparatus, the apparatus comprising:

(a) means for receiving force imparted by a user's first appendage, wherein appendage is an arm or a leg;

(b) means for receiving force imparted by the user's second appendage;

(c) means for providing both resistance and assistance to the force imparted by the user's first appendage, wherein the assistance and resistance varies as a function of the force received by (b);

(d) means for providing both resistance and assistance to the force imparted by the user's second appendage;

wherein differential resistance and assistance is provided by (c) relative to (d).

13. The apparatus of claim 12, wherein the assistance and resistance imparted by (d) varies as a function of the force received by (a).

14. The apparatus of claim 12, wherein at least one of (c) and (d) comprises a drive motor.

* * * * *